US005673023A

United States Patent [19]

Smith

[11] Patent Number: 5,673,023

[45] Date of Patent: Sep. 30, 1997

[54] LOCATING SYSTEM WITH BOTH VISUAL AND VOICE SIMULATED INDICATION CAPABILITIES

[76] Inventor: Bradley K. Smith, R.R.1, Site 4, Comp 7, Peachland, Canada, VOH IX0

[21] Appl. No.: 656,829

[22] Filed: Jun. 3, 1996

[51] Int. Cl.[6] ..... G08B 1/08

[52] U.S. Cl. ..... 340/571; 340/539; 340/540; 340/691; 340/692; 340/693; 340/825.36; 340/825.49

[58] Field of Search ..... 340/571, 540, 340/539, 691, 692, 693, 825.36, 825.49

[56] References Cited

U.S. PATENT DOCUMENTS

| | | | |
|---|---|---|---|
| D. 339,759 | 9/1993 | Ho | D10/106 |
| 4,101,873 | 7/1978 | Anderson et al. | 340/539 |
| 4,476,469 | 10/1984 | Lander | 340/825.49 |
| 4,507,653 | 3/1985 | Bayer | 340/539 |
| 5,204,657 | 4/1993 | Prosser et al. | 340/825.49 |
| 5,294,915 | 3/1994 | Owen | 340/539 |
| 5,598,143 | 1/1997 | Wentz | 340/539 |

*Primary Examiner*—Glen Swann

[57] ABSTRACT

A locating system including a transmitter housing having a plurality of button switches situated thereon. Also included is at least one receiver housing coupled to an object. A speaker, button key, and high intensity strobe light are situated on the receiver housing. The transmitter housing is equipped with transmitter circuitry for emitting one of a plurality of unique signals upon the instantaneous depression of an associated button on the transmitter housing. Receiver circuitry is situated within the receiver housing and is adapted to activate upon the receipt of an associated signal transmitted via the transmitter circuitry. The receiver circuitry is further adapted to deactivate only upon the depression of the key on the receiver housing. Also included is audible receiving indication circuitry for emitting an audible signal via the speaker comprising a short descriptive phrase representative of the object to which the receiver housing is connected. The audible signal is only emitted upon the activation of the receiver circuitry. Finally, visual receiving indication circuitry is connected to the receiver circuitry and strobe light of the receiver housing for allowing the intermittent actuation of the strobe light upon the activation of the receiver circuitry.

6 Claims, 5 Drawing Sheets

LOCATING SYSTEM WITH BOTH VISUAL AND VOICE SIMULATED INDICATION CAPABILITIES

BACKGROUND OF THE INVENTION

1. Field of the Invention

The present invention relates to a locating system with both visual and voice simulated indication capabilities and more particularly pertains to affording a dual method of locating a misplaced object via a device which can be conveniently deactivated upon the recovery of the lost object.

2. Description of the Prior Art

The use of locating systems is known in the prior art. More specifically, locating systems heretofore devised and utilized for the purpose of recovering lost objects are known to consist basically of familiar, expected and obvious structural configurations, notwithstanding the myriad of designs encompassed by the crowded prior art which have been developed for the fulfillment of countless objectives and requirements.

By way of example, the prior art comprises U.S. Pat. No. 4,101,873 to Anderson et al.; U.S. Pat. No. 4,507,653 to Bayer; U.S. Pat. Des. No. 339,757; U.S. Pat. No. 5,289,163 to Perez et al.; U.S. Pat. No. 5,204,657 to Prosser et al.; U.S. Pat. No. 5,121,096 to Moore et al.; U.S. Pat. No. 5,294,915 to Owen; and U.S. Pat. No. 4,476,469 to Lander.

In this respect, the locating system with both visual and voice simulated indication capabilities according to the present invention substantially departs from the conventional concepts and designs of the prior art, and in so doing provides an apparatus primarily developed for the purpose of affording a dual method of locating a misplaced object via a device which can be conveniently deactivated upon the recovery of the lost object.

Therefore, it can be appreciated that there exists a continuing need for a new and improved locating system with both visual and voice simulated indication capabilities that can be used for affording a dual method of locating a misplaced object via a device that can be conveniently deactivated upon the recovery of the lost object. In this regard, the present invention substantially fulfills this need.

SUMMARY OF THE INVENTION

In view of the foregoing disadvantages inherent in the known types of locating systems now present in the prior art, the present invention provides an improved locating system with both visual and voice simulated indication capabilities. As such, the general purpose of the present invention, which will be described subsequently in greater detail, is to provide a new and improved locating system with both visual and voice simulated indication capabilities which has all the advantages of the prior art and none of the disadvantages.

To attain this, the present invention essentially comprises a transmitter housing with a top face, a bottom face, and a periphery formed therebetween defining an interior space. The top face has a first portion, a second portion, and a bevelled intermediate portion formed therebetween. The second portion is situated in a plane that resides above a plane in which the first portion resides. The transmitter housing further has a plurality of button switches situated on the first portion thereof in linear alignment. A plurality of indicators are situated on the intermediate portion with each indicator comprising a transparent window. Each transparent window is capable of releasably receiving a strip of translucent material with opaque indicia printed thereon. A plurality of light emitting diodes are each situated within the interior space of the transmitter housing adjacent an associated transparent window. The light emitting diodes are adapted to emit light upon the actuation thereof. As shown in FIG. 3, at least one receiver housing is included with a top face, a bottom face, and a periphery formed therebetween defining an interior space. The receiver housing comprises a speaker situated within the interior space thereof adjacent a grill formed therein. A high intensity strobe light is situated on the periphery of the receiver housing for emitting high intensity light upon the actuation thereof. A key is also located on the periphery of the receiver housing. An adhesive lining is positioned on the bottom face of the receiver housing for being adhered to an object. Further included is transmitter circuitry situated within the transmitter housing. The transmitter circuitry is connected to the buttons for emitting a plurality of unique signals. Each signal is transmitted only upon the instantaneous depression of an associated button on the transmitter housing. Transmitting indication circuitry is positioned within the transmitter housing and connected to the light emitting diodes. The transmitting indication circuitry is adapted to allow the actuation of a diode upon the depression of an associated button. Further included is receiver circuitry situated within the receiver housing. The receiver circuitry is included for activating upon the receipt of an associated signal transmitted via the transmitter circuitry. The receiver circuitry is adapted to deactivate only upon the depression of the key on the receiver housing. Audible receiving indication circuitry is connected to the receiver circuitry and speaker of the receiver housing. The audible receiving indication circuitry is included for emitting an audible signal. The audible signal comprises a short descriptive phrase representative of the object to which the receiver housing is connected. The audible receiving indication circuitry only emits an audible signal upon the activation of the receiver circuitry. Finally, visual receiving indication circuitry is connected to the receiver circuitry and strobe light of the receiver housing. The visual receiving indication circuitry allows the intermittent actuation of the strobe light only upon the activation of the receiver circuitry.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved locating system with both visual and voice simulated indication capabilities which has all the advantages of the prior art locating systems and none of the disadvantages.

It is another object of the present invention to provide a new and improved locating system with both visual and voice simulated indication capabilities which may be easily and efficiently manufactured and marketed.

It is a further object of the present invention to provide a new and improved locating system with both visual and voice simulated indication capabilities which is of a durable and reliable construction.

An even further object of the present invention is to provide a new and improved locating system with both visual and voice simulated indication capabilities which is susceptible of a low cost of manufacture with regard to both materials and labor, and which accordingly is then susceptible of low prices of sale to the consuming public, thereby making such locating system with both visual and voice simulated indication capabilities economically available to the buying public.

Still yet another object of the present invention is to provide a new and improved locating system with both visual and voice simulated indication capabilities which provides in the apparatuses and methods of the prior art some of the advantages thereof, while simultaneously overcoming some of the disadvantages normally associated therewith.

Still another object of the present invention is to afford a dual method of locating a misplaced object via a device which can be conveniently deactivated upon the recovery of the lost object.

Lastly, it is an object of the present invention to provide a new and improved locating system including a transmitter housing having a plurality of button switches situated thereon. Also included is at least one receiver housing coupled to an object. A speaker, button key, and high intensity strobe light are situated on the receiver housing. The transmitter housing is equipped with transmitter circuitry for emitting one of a plurality of unique signals upon the instantaneous depression of an associated button on the transmitter housing. Receiver circuitry is situated within the receiver housing and is adapted to activate upon the receipt of an associated signal transmitted via the transmitter circuitry. The receiver circuitry is further adapted to deactivate only upon the depression of the key on the receiver housing. Also included is audible receiving indication circuitry for emitting an audible signal via the speaker comprising a short descriptive phrase representative of the object to which the receiver housing is connected. The audible signal is only emitted upon the activation of the receiver circuitry. Finally, visual receiving indication circuitry is connected to the receiver circuitry and strobe light of the receiver housing for allowing the intermittent actuation of the strobe light upon the activation of the receiver circuitry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
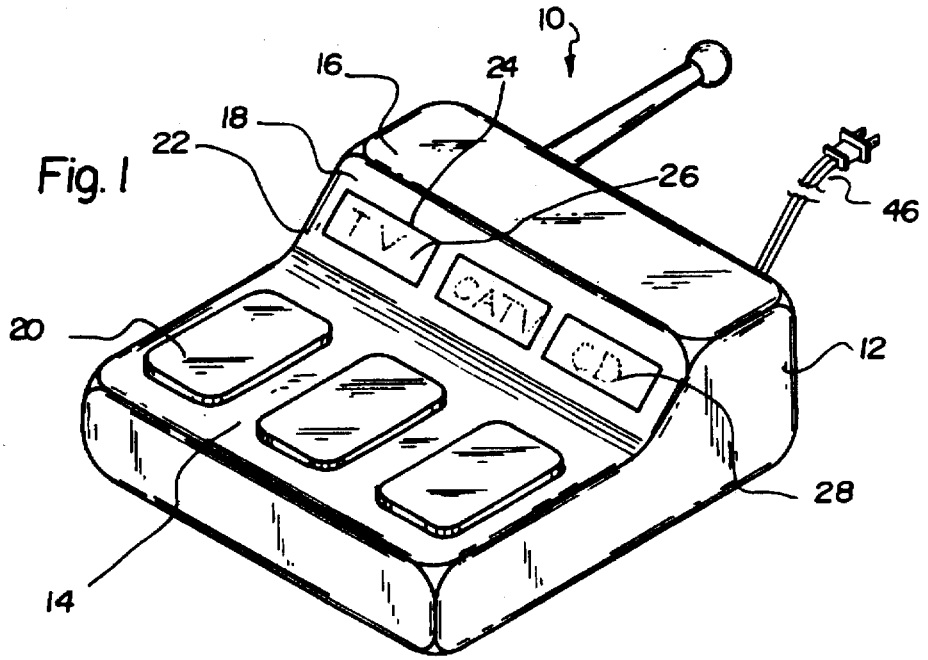
FIG. 1 is a perspective illustration of the preferred embodiment of the locating system with both visual and voice simulated indication capabilities constructed in accordance with the principles of the present invention.
Figure 2:
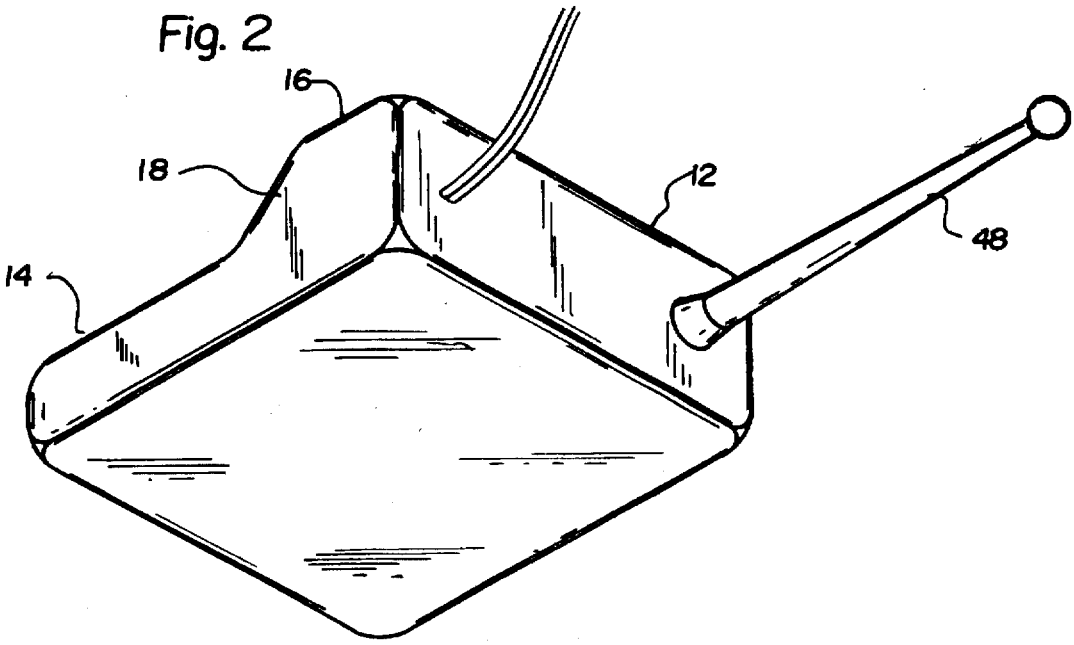
FIG. 2 is a bottom isomeric view of the transmitter housing.

With reference now to the drawings, and in particular to FIG. 1 thereof, a new and improved locating system with both visual and voice simulated indication capabilities embodying the principles and concepts of the present invention and generally designated by the reference numeral 10 will be described.

The present invention, the new and improved locating system with both visual and voice simulated indication capabilities, is comprised of a plurality of components. Such components in their broadest context include a transmitter housing, receiver housing, transmitter circuitry, transmitting indication circuitry, receiver circuitry, visual receiving indication circuitry, and audible receiving indication circuitry. Such components are individually configured and correlated with respect to each other so as to attain the desired objective.

More specifically, it will be noted that the system 10 of the present invention including a transmitter housing 12 with a top face, a bottom face, and a periphery formed therebetween defining an interior space. The top face has a first portion 14, a second portion 16, and a bevelled intermediate portion 18 formed therebetween. The second portion is situated in a plane that resides above a plane in which the first portion resides. The transmitter housing further has a plurality of button switches 20 situated on the first portion thereof in linear alignment. A plurality of indicators 22 are situated on the intermediate portion with each indicator comprising a transparent window 24. Such positioning affords a convenient view of the windows. Each transparent window is capable of releasably receiving a strip of translucent material 26 with opaque indicia 28 printed thereon. The indicia is indicative of an object which is commonly lost or misplaced. A plurality of light emitting diodes 30 are each situated within the interior space of the transmitter housing adjacent an associated transparent window. The light emitting diodes are adapted to emit light upon the actuation thereof. The transmitter housing is preferably constructed of a rigid plastic.

Figure 3:
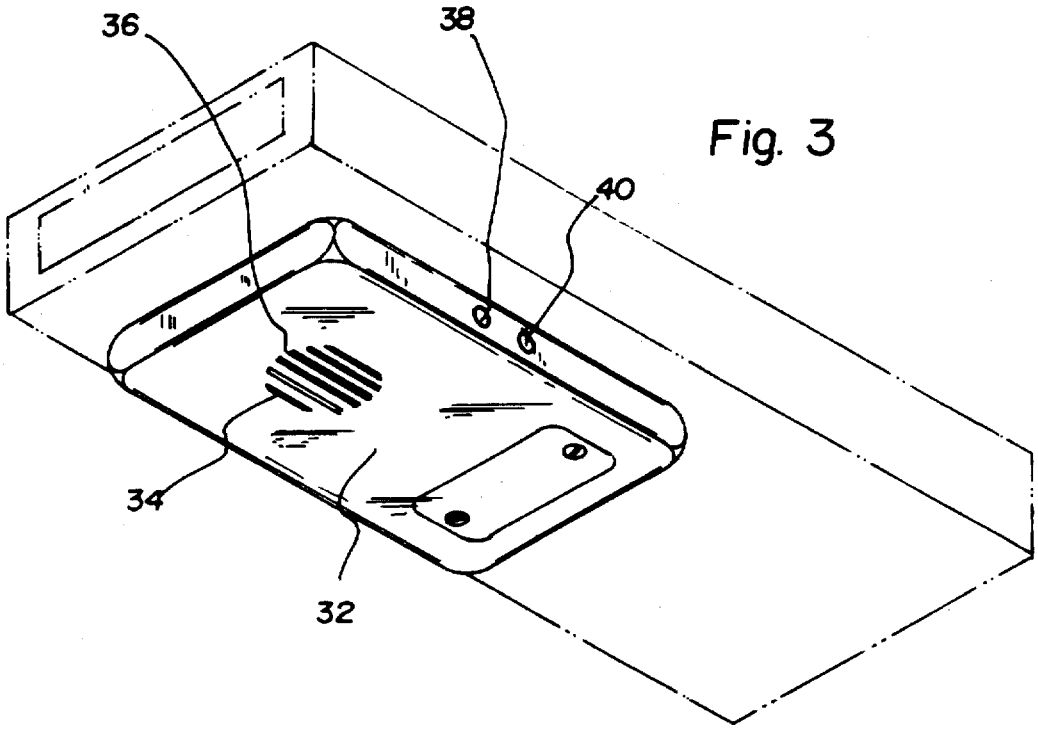
FIG. 3 is a bottom perspective depiction of the receiver in use.
Figure 4:
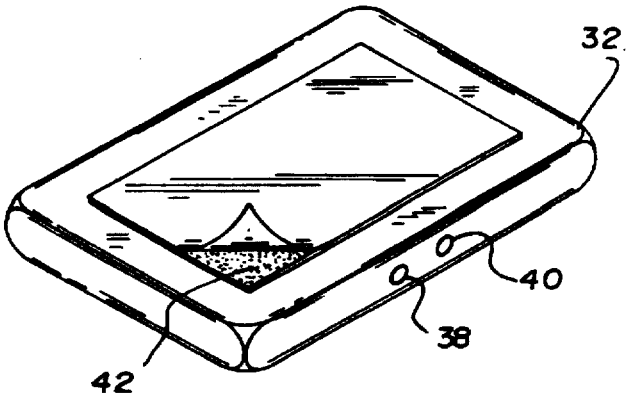
FIG. 4 is a bottom isomeric view of the receiver housing of the present invention.

As shown in FIG. 3, at least one receiver housing 32 is included with a top face, a bottom face, and a periphery formed therebetween defining an interior space. The receiver housing is constructed of a rigid plastic and comprises a speaker 34 situated within the interior space thereof adjacent a grill 36 formed therein. A high intensity strobe light 38 is situated on the periphery of the receiver housing for emitting high intensity light upon the actuation thereof. A key 40 is also located on the periphery of the receiver housing. An adhesive lining 42 is positioned on the bottom face of the receiver housing for allowing the receiver housing to be adhered to an object.

Figure 5:
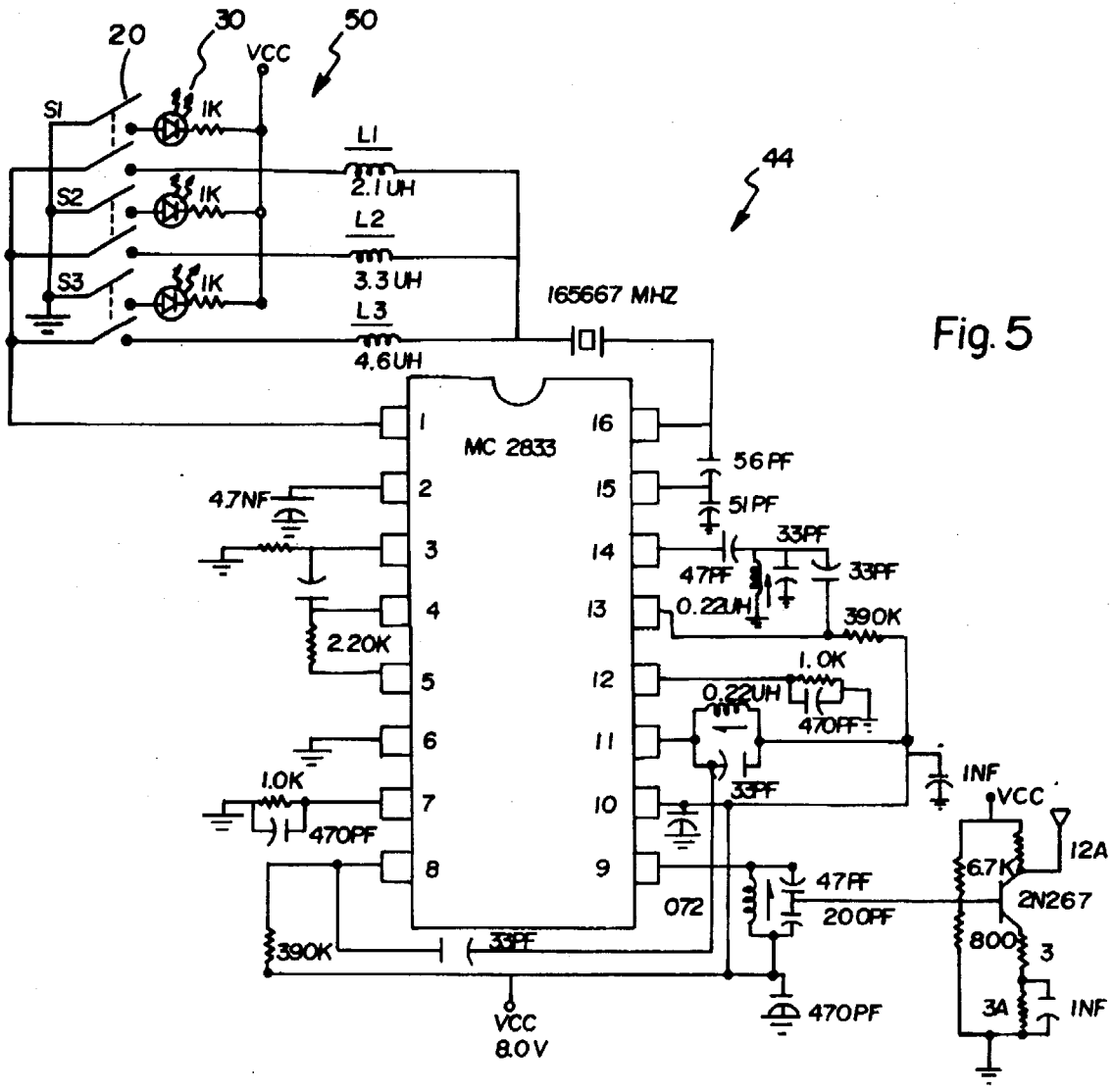
FIG. 5 is a schematic of the circuitry employed in the transmitter housing.
Figure 6:
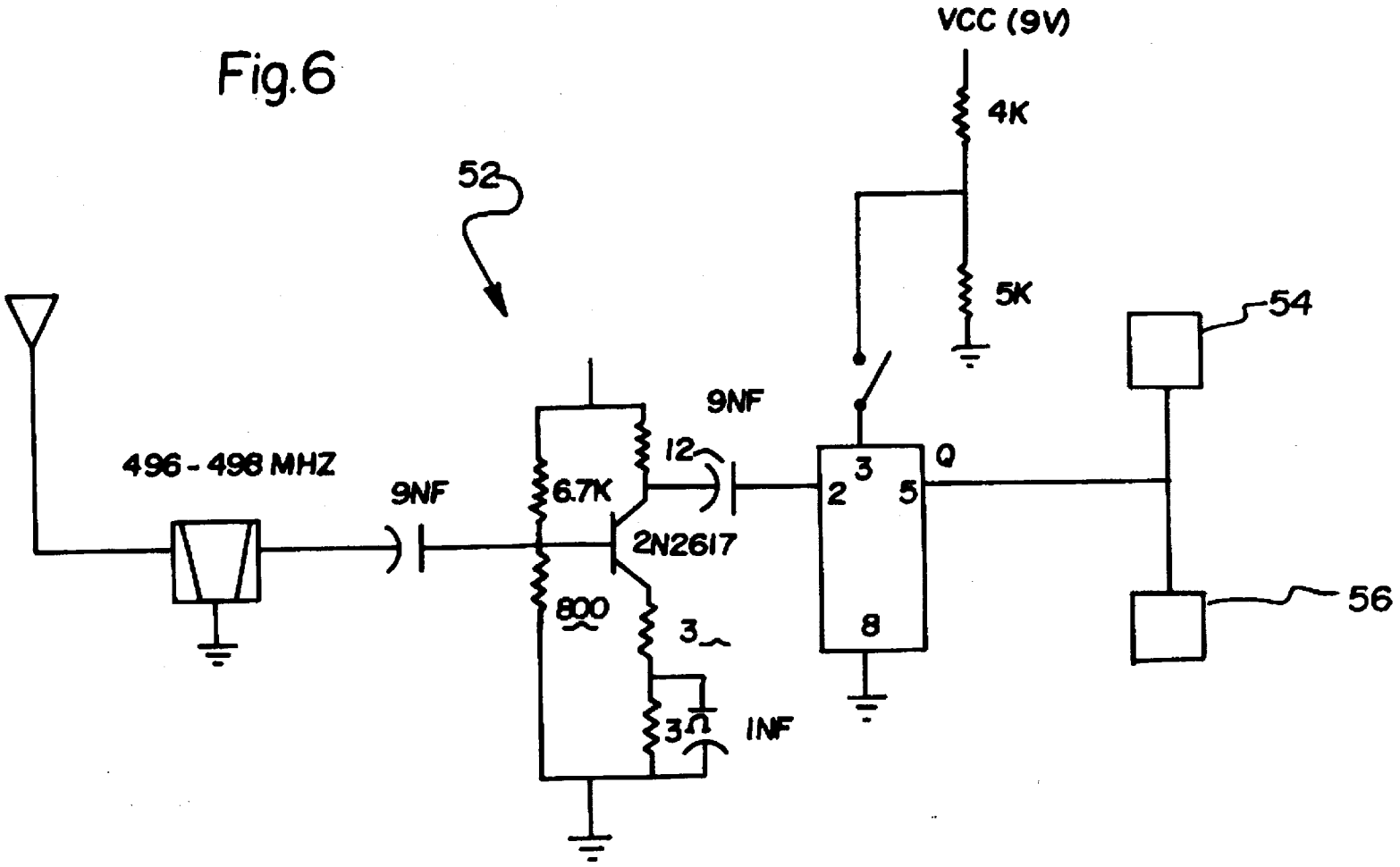
FIG. 6 is a schematic of the circuitry employed in the receiver housing.
Figure 7:
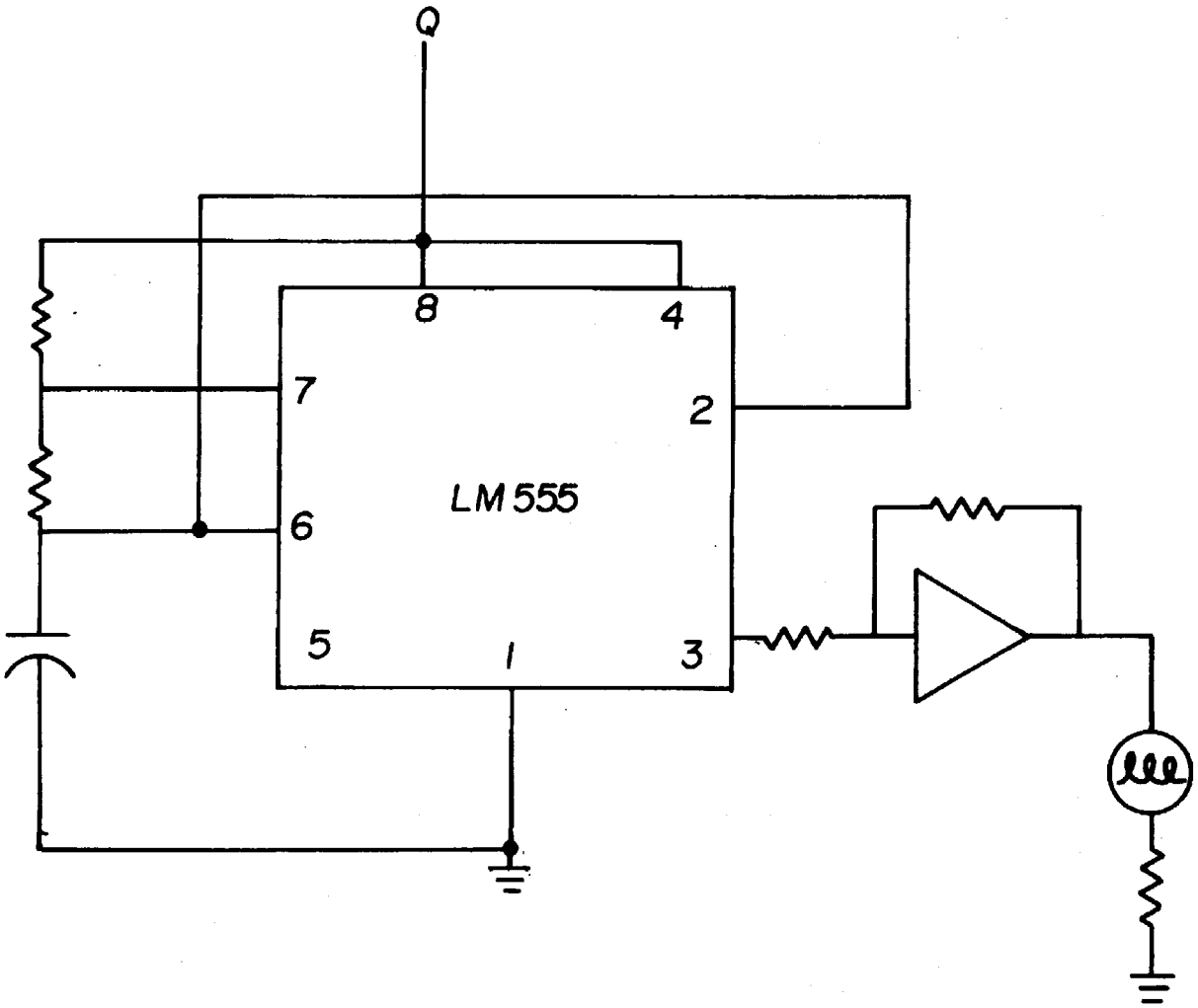
FIG. 7 is a schematic of additional circuitry employed in the receiver housing.

Further included is transmitter circuitry 44 shown in FIG. 5 to be situated within the transmitter housing. The transmitter housing receives power from a conventional power receptacle via a power cord 46. The transmitter circuitry is connected to the buttons for emitting a plurality of unique signals each at a predetermined frequency. Each signal is transmitted only upon the instantaneous depression of an associated button on the transmitter housing. To accomplish the foregoing, the transmitter circuitry comprises a MC2833 chip with a plurality of RC networks coupled to peripheral pins thereof. The RC networks allow the chip to generate the unique signals to be transmitted. An antenna 48 and associated transmission network are also coupled to the chip for transmitting via free space the unique signals.

Transmitting indication circuitry 50 is positioned within the transmitter housing and connected to the light emitting diodes. The transmitting indication circuitry is adapted to allow the actuation of a diode upon the depression of an associated button. The transmitting indication circuitry includes a high frequency crystal in combination with a plurality of inductors to effect the high speed intermittent actuation of the light emitting diodes upon the depression of the button switches. It should be noted that the button switches are double poled for facilitating the actuation of both the transmitter circuitry and the transmitting indication circuitry upon the depression thereof.

Further included is receiver circuitry 52 situated within the receiver housing. The receiver circuitry is included for activating upon the receipt of an associated signal transmitted via the transmitter circuitry. The receiver circuitry is adapted to deactivate only upon the depression of the key on the receiver housing. Preferably, the receiver circuitry includes a unique crystal in combination with a signal amplification circuit for receiving only an associated signal. Also included is an application specific chip adapted to pull an output thereof high upon the receipt of an amplified signal at an input thereof via the signal amplification circuit. The chip is further adapted to maintain the activated state after the cessation of the received signal. The chip further includes an active low enable which allows the deactivation thereof upon the receipt of current by circuitry of the depression of the key. The present circuitry thus allows a user to instantaneously depress a button switch of the transmitter housing to afford continued activation of the receiver. Ideally, the receiver circuitry is powered by a conventional 9-volt battery.

Audible receiving indication circuitry 54 is connected to the speaker of the receiver housing and the output of the application specific chip of the receiver circuitry. The audible receiving indication circuitry is included for emitting an audible signal. The audible signal comprises a short descriptive phrase representative of the object to which the receiver housing is connected. The audible receiving indication circuitry only emits an audible signal when the receiver circuitry is activated. The components employed in the present circuitry are commercially available and commonly known especially in the art of greeting cards. To afford an audible signal unique to the associated object, a plurality of unillustrated micro-selection switches are accessible via a removable panel formed on the top face of the receiver housing. The switches allow the selection of one of a plurality of audible phrases which describe a set of commonly lost objects. A generic phrase is included in the set for describing an object for which there is not an audible phrase.

Finally, visual receiving indication circuitry 56 is connected to the output of the application specific chip of the receiver circuitry and further connected to the strobe light of the receiver housing. The visual receiving indication circuitry allows the intermittent actuation of the strobe light only when the receiver circuitry is activated. Such is critical to afford a dual method of locating a lost object. The visual receiving indication circuitry comprises a multivibrator for producing an output which oscillates at a predetermined rate. An operational amplifier is included in combination with a resistive network for effecting intermittent actuation of the strobe as a function of the output of the multivibrator. The rate of actuation of the strobe is dependent upon the design of the multivibrator.

The present invention thus affords a dual method of locating a misplaced object which can be conveniently deactivated upon the recovery of the lost object. The present device may be utilized to find keys, remote controls, portable phones, briefcases, eye glasses and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved locating system with both visual and voice simulated indication capabilities comprising, in combination:

a transmitter housing with a top face, a bottom face, and a periphery formed therebetween defining an interior space, the top face having a first portion, a second portion, and a bevelled intermediate portion formed therebetween with the second portion situated in a plane which resides above a plane in which the first portion resides, the transmitter housing further having a plurality of button switches situated on the first portion of the housing in linear alignment, a plurality of indicators situated on the intermediate portion with each indicator comprising a transparent window capable of releasably receiving a strip of translucent material with opaque indicia printed thereon, and a plurality of light emitting diodes each situated within the interior space adjacent an associated transparent window and adapted to emit light upon the actuation thereof;

at least one receiver housing with a top face, a bottom face, and a periphery formed therebetween defining an interior space, the receiver housing comprising a speaker situated within the interior space of the receiver housing adjacent a grill formed therein, a high intensity strobe light situated on the periphery of the receiver housing for emitting high intensity light upon the actuation thereof, a key also situated on the periphery of the receiver housing, and an adhesive lining situated on the bottom face of the receiver housing for being adhered to an object;

transmitter means situated within the transmitter housing and connected to the buttons for emitting a plurality of unique signals each at a predetermined frequency and with each signal being transmitted upon the instantaneous depression of an associated button on the transmitter housing;

transmitting indication means positioned within the transmitter housing and connected to the light emitting diodes for allowing the actuation of a diode upon the depression of an associated button;

receiver means situated within the receiver housing and adapted to activate upon the receipt of an associated signal transmitted via the transmitter means, the receiver means adapted to deactivate only upon the depression of the key on the receiver housing;

audible receiving indication means connected to the receiver means and speaker of the receiver housing for emitting an audible signal comprising a short descriptive phrase representative of the object to which the receiver housing is connected, wherein the audible receiving indication means only emits an audible signal upon the activation of the receiver means; and visual receiving indication means connected to the receiver means and strobe light of the receiver housing for allowing the intermittent actuation of the strobe light only upon the activation of the receiver means.

2. A locating system comprising:

a transmitter housing having a plurality of button switches situated thereon;

at least one receiver housing comprising a speaker situated thereon and a key situated on a periphery thereof, wherein the receiver housing is coupled to an object;

transmitter means situated within the transmitter housing and connected to the buttons for emitting a plurality of unique signals at a predetermined frequency with each signal being transmitted upon the instantaneous depression of an associated button on the transmitter housing;

receiver means situated within the receiver housing and adapted to activate upon the receipt of an associated signal transmitted via the transmitter means, the receiver means adapted to deactivate only upon the depression of the key on the receiver housing; and audible receiving indication means connected to the receiver means and speaker of the receiver housing for emitting an audible signal comprising a short descriptive phrase representative of the object to which the receiver housing is connected, wherein the audible receiving indication means only emits an audible signal upon the activation of the receiver means.

3. A locating system as set forth in claim 2 wherein the transmitter housing has a top face, a bottom face, and a periphery formed therebetween defining an interior space, the top face having a first portion, a second portion, and a bevelled intermediate portion formed therebetween with the second portion situated in a plane which resides above a plane in which the first portion resides.

4. A locating system as set forth in claim 2 and further comprising a plurality of indicators situated on the transmitter housing with each indicator having a transparent window capable of releasably receiving a strip of translucent material with opaque indicia printed thereon, a plurality of light emitting diodes each situated adjacent an associated transparent window and adapted to emit light upon the actuation thereof, and transmitting indication means positioned within the transmitter housing and connected to the light emitting diodes for allowing the actuation of a diode upon the depression of an associated button.

5. A locating system as set forth in claim 2 and further comprising a high intensity strobe light situated on the receiver housing for emitting high intensity light upon the actuation thereof and visual receiving indication means connected to the receiver means and the strobe light of the receiver housing for allowing the intermittent actuation of the strobe light only upon the activation of the receiver means.

6. A locating system comprising:

a transmitter housing having a plurality of button switches situated thereon;

at least one receiver housing comprising a light situated thereon and a key situated on a periphery thereof, wherein the receiver housing is coupled to an object;

transmitter means situated within the transmitter housing and connected to the buttons for emitting a plurality of unique signals at a predetermined frequency with each signal being transmitted upon the instantaneous depression of an associated button on the transmitter housing;

receiver means situated within the receiver housing and adapted to activate upon the receipt of an associated signal transmitted via the transmitter means, the receiver means adapted to deactivate only upon the depression of the key on the receiver housing; and visual receiving indication means connected to the receiver means and light of the receiver housing for allowing the actuation of the light only upon the activation of the receiver means.

* * * * *